US007941874B2

(12) United States Patent
Chou

(10) Patent No.: US 7,941,874 B2
(45) Date of Patent: May 17, 2011

(54) SWIMMING OR DIVING GOGGLES

(76) Inventor: Terry Chou, Tainan (TW)

( * ) Notice: Subject to any disclaimer, the term of this patent is extended or adjusted under 35 U.S.C. 154(b) by 133 days.

(21) Appl. No.: 12/422,270

(22) Filed: Apr. 11, 2009

(65) Prior Publication Data

US 2010/0257660 A1 Oct. 14, 2010

(51) Int. Cl.
*A63B 33/00* (2006.01)
*A61F 9/04* (2006.01)
*A63B 31/00* (2006.01)

(52) U.S. Cl. ..... 2/440; 2/428; 2/430; 2/439; 351/43; 359/665

(58) Field of Classification Search ..... 2/428, 430, 2/440, 439; 351/43; 359/665
See application file for complete search history.

(56) References Cited

U.S. PATENT DOCUMENTS 2,525,921 A * 10/1950 Madan et al. ..... 359/665
3,040,616 A * 6/1962 Simpson ..... 359/481
3,483,569 A * 12/1969 Armendariz ..... 2/430
3,694,814 A * 10/1972 De Barbieri et al. ..... 2/428
5,204,700 A * 4/1993 Sansalone ..... 351/43
6,195,807 B1 * 3/2001 Chou ..... 2/428
6,473,909 B1 * 11/2002 Chou ..... 2/428
7,194,771 B2 * 3/2007 Chou ..... 2/428
D547,788 S * 7/2007 Cheng ..... D16/311
2003/0229935 A1 * 12/2003 Chou ..... 2/440
2005/0010995 A1 * 1/2005 Chou ..... 2/428
2006/0005304 A1 * 1/2006 Chou ..... 2/426
2009/0064398 A1 * 3/2009 Chou ..... 2/439
2009/0064399 A1 * 3/2009 Chou ..... 2/442

* cited by examiner

*Primary Examiner* — Bobby H Muromoto, Jr.

(57) ABSTRACT

Swimming or diving goggles includes a lens unit including two viewing sections. A front face of each viewing section is a portion of a peripheral face of a cone. The cone has an apex and a bottom face, and the peripheral face extends between the apex and the bottom face. A spacing from a top face of each viewing section to a vertical axis passing through a center of the bottom face in the thickness direction is smaller than a spacing from a bottom face of the viewing section to the vertical axis in the thickness direction. A normal plane perpendicular to each of the two viewing sections is at an acute angle with the vertical axis. Each viewing section is a curved face in a circumferential direction about the vertical axis. A frame mechanism is coupled to the lens unit and in intimate contact with eye sockets of a wearer.

11 Claims, 24 Drawing Sheets

A-A

B-B

SWIMMING OR DIVING GOGGLES

BACKGROUND OF THE INVENTION

The present invention relates to swimming or diving goggles and, more particularly, to swimming or diving goggles with a larger visual field and enhanced visibility in water.

Swimming or diving goggles generally include two lenses and a sealing frame. The lenses can be separate or integrally formed with each other as a single monolithic piece. The sealing frame is in intimate contact with eye sockets of a wearer to protect the eyes and to improve visibility during swimming or diving.

FIG. 21 shows conventional swimming or diving goggles including planar lenses 10' received in a frame 11'. When the wearer is swimming with his or her face facing downward, his or her eyes look through each lens 10' along an axis 1*d'* above and at an acute angle 1*e'* with a normal axis 1*c'* perpendicular to the lens 10', leading to poor visibility and hindering the visual field 2b' while increasing resistance in water.

FIG. 22 shows another conventional swimming or diving goggles including a spherical lens 20' having crescent cross sections to reduce resistance in water. However, the curvature of the spherical lenses 20' is not suitable to all of the wearers such that the distance 2*a'* between the face of the wearer and the central portion of the spherical lens 20' may be undesirably large.

FIGS. 23 and 24 show another conventional swimming or diving goggles including an arcuate lens 30' and a sealing frame 31' in intimate contact with the face of the wearer. The curvature of the arcuate lens 30' reduces resistance in water. However, when the wearer is swimming with his or her face facing downward, his or her eyes look through the lens 30' along an axis 3*d'* above and at an acute angle 3*c'* with a normal axis 3*b'* perpendicular to the lens 30', leading to poor visibility and hindering the visual field 3*a'*.

U.S. Patent Application No. 2004/0064875 discloses swimming or diving goggles including a pair of lenses that are separate or carried out as one piece, and a sealing frame surrounding the lenses. Each lens is provided with a temporal portion and a nasal portion. The nasal portion is bent in a substantially horizontal plane and follows a first theoretical cylindrical surface with substantially vertical generatrixes. The temporal portion is bent in a second theoretical cylindrical surface having a combined bend both on a horizontal plane and on a vertical plane. However, such lenses still have the disadvantages of reduced visual field and poor visibility.

U.S. Patent Application Publication No. 2006/0010587 discloses swimming or diving goggles including left and right eye cups each having a forward-viewing section and a difficult-viewing section below the forward-viewing section. However, both the forward-viewing section and the difficult-viewing sections have bends leading to blind spots in the visual field while the curvatures of the eye cups result in increased resistance in water.

BRIEF SUMMARY OF THE INVENTION

An objective of the present invention is to provide swimming or diving goggles with a larger visual field and enhanced visibility in water.

Swimming or diving goggles according to the preferred teachings of the present invention includes a lens unit made of rigid material and having two separate lenses or a single monolithic lens. The lens unit includes two viewing sections each having front and rear faces spaced in a thickness direction. The front face is a portion of a peripheral face of a cone. The cone has an apex and a bottom face, and the peripheral face extends between the apex and the bottom face. Each viewing section has top and bottom faces spaced in a vertical direction perpendicular to the thickness direction. A spacing from the top face of each viewing section to a vertical axis passing through a center of the bottom face in the thickness direction is smaller than a spacing from the bottom face of the viewing section to the vertical axis in the thickness direction. A normal plane perpendicular to each of the two viewing sections is at an acute angle with the vertical axis. Each viewing section is a curved face in a circumferential direction about the vertical axis. A frame mechanism is coupled to the lens unit and in intimate contact with eye sockets of a wearer wearing the swimming or diving goggles.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
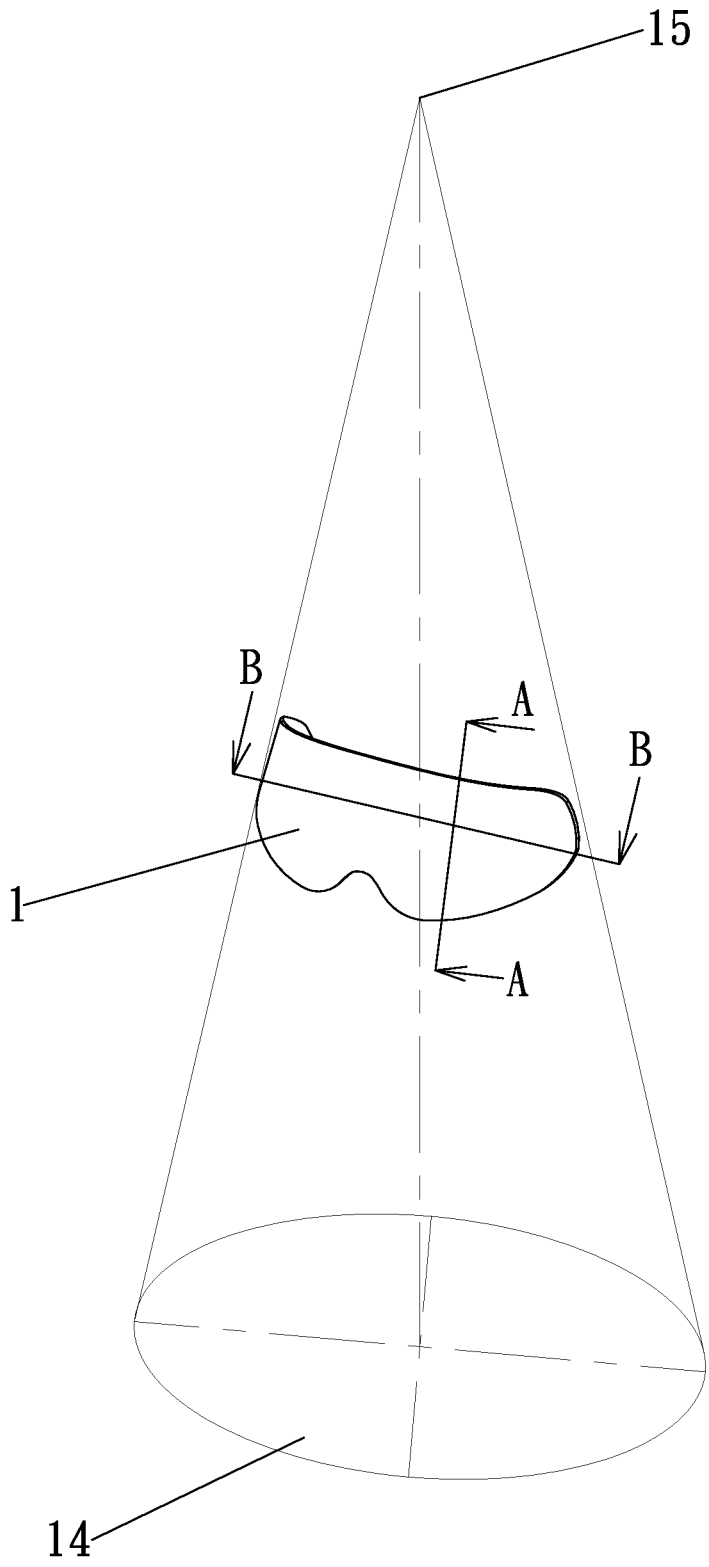
FIG. 1 shows a perspective view of a lens unit of swimming or diving goggles of a first embodiment according to the preferred teachings of the present invention.
Figure 2:
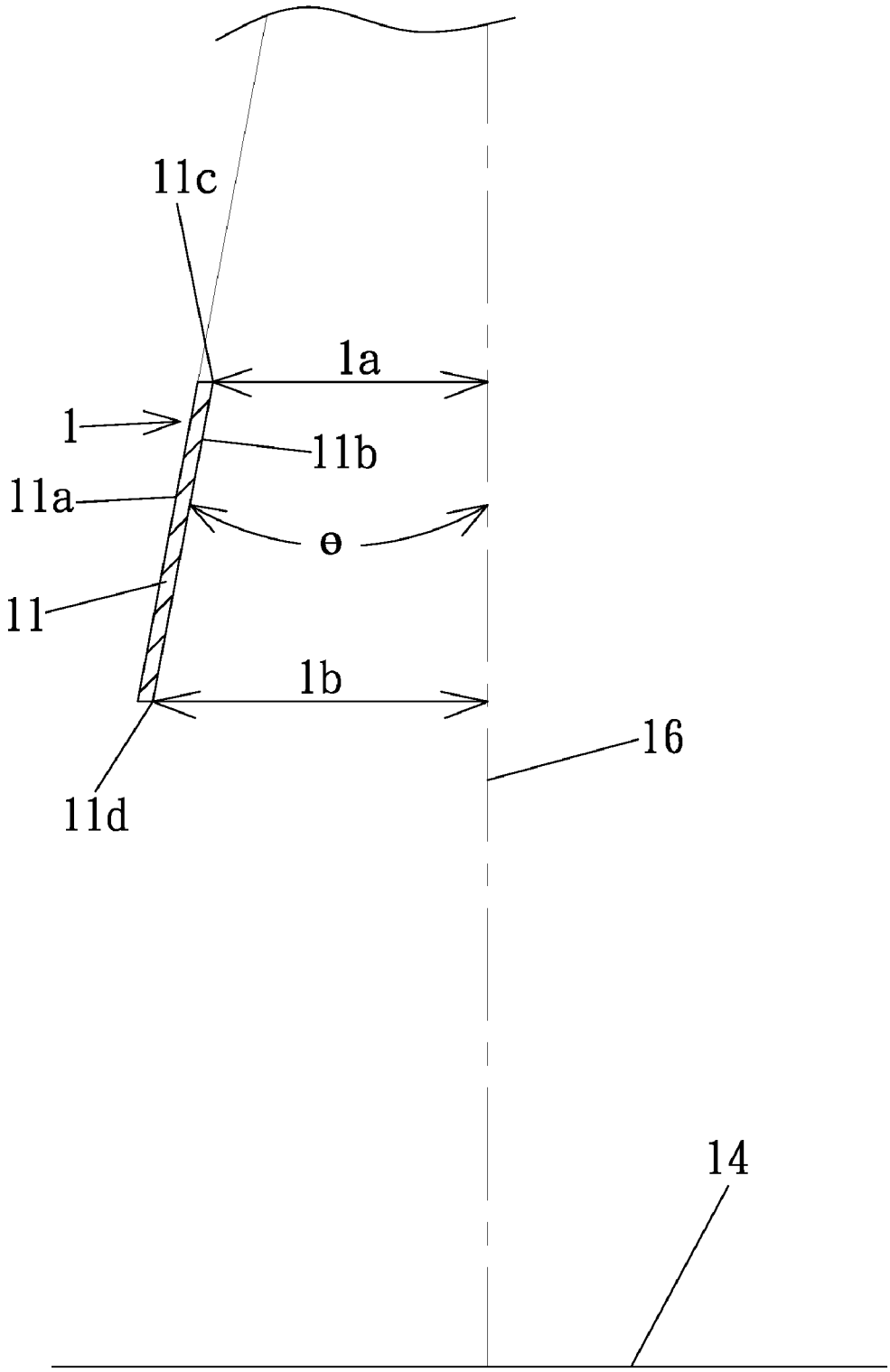
FIG. 2 shows a cross sectional view of the lens unit of FIG. 1 according to section line A-A in FIG. 1.
Figure 3:
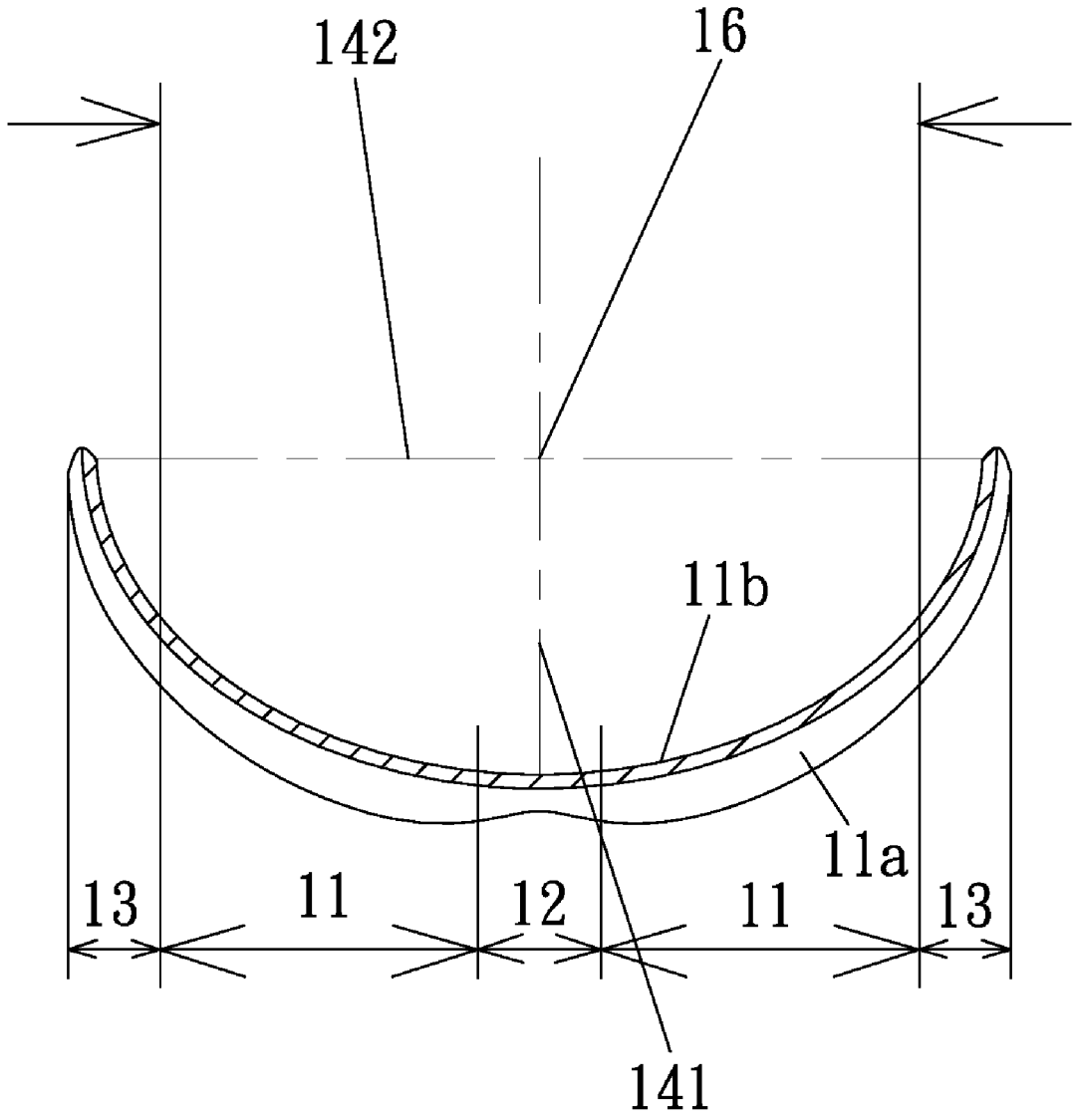
FIG. 3 shows a cross sectional view of the lens unit of FIG. 1 according to section line B-B in FIG. 1.
Figure 4:
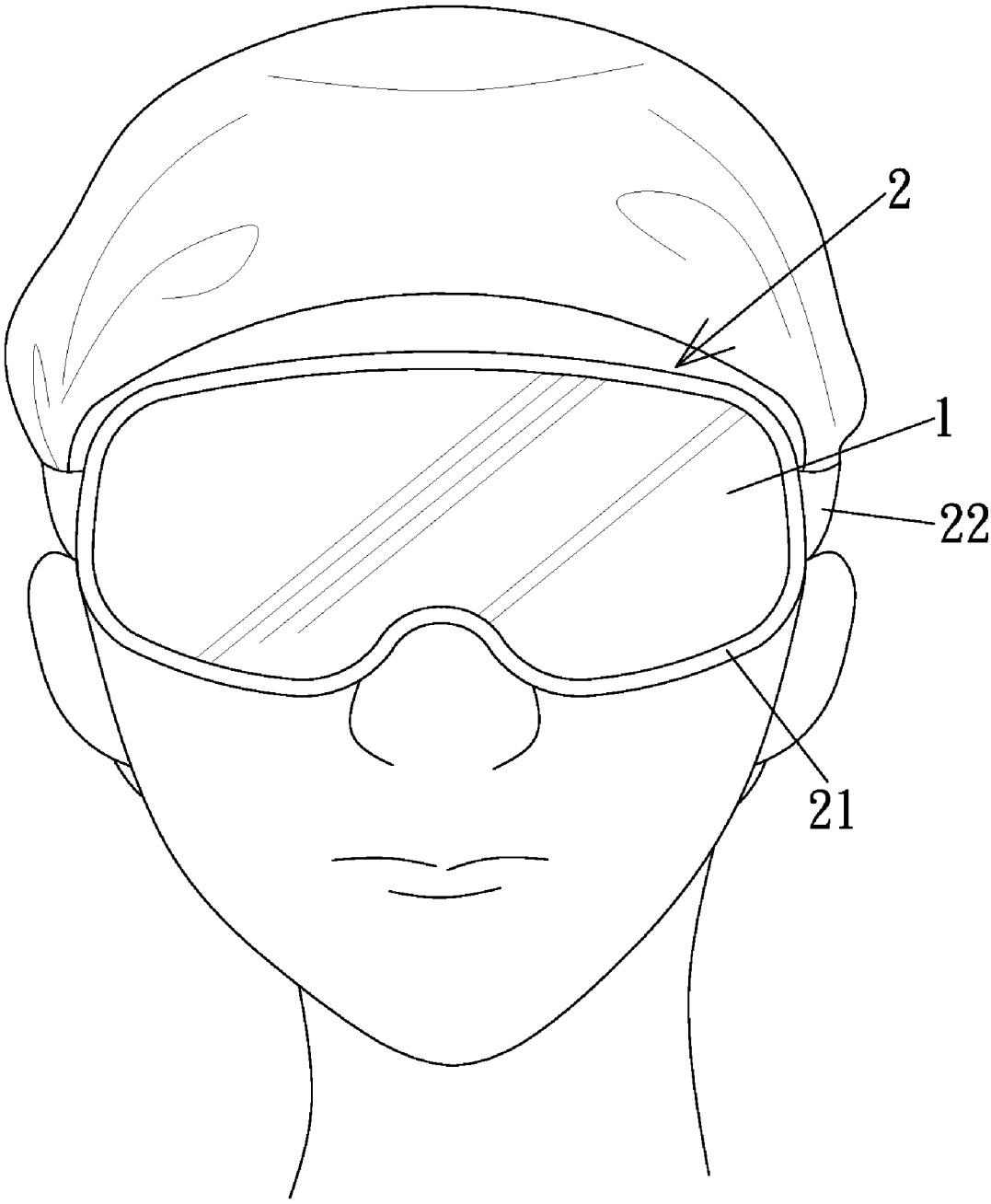
FIG. 4 shows a front view of the goggles of FIG. 1 with the lens unit coupled with a frame mechanism and with the goggles worn on a wearer.

FIGS. 1-8 show swimming or diving goggles of a first embodiment according to the preferred teachings of the present invention. In this embodiment, goggles include a rigid lens unit 1 in the form of a single monolithic lens and a frame mechanism 2. The lens unit 1 is made of rigid material and includes a nasal section 12, two viewing sections 11 on opposite sides of the nasal section 12, and two side sections 13 on opposite sides of the viewing sections 11. Each viewing section 11 is intermediate the nasal section 12 and one of the side sections 13 in a width direction. Each viewing sections 11 corresponds to an area between a nose and one of two temples of a wearer. The nasal section 12 corresponds to a location of the nose of the wearer. Each side section 13 corresponds to a location of one of the temples of the wearer. Each viewing section 11 includes a front face 11*a* and a rear face 11*b* spaced from the front face 11*a* in a thickness direction perpendicular to the width direction. The front face 11*a* is a portion of a three-dimensional shape of a cone having a bottom face 14, an apex 15, and a peripheral face extending between the apex 15 and the bottom face 14. In this embodiment, the cone includes elliptical cross sections with a vertical axis 16 passing through the apex 15 and a center of the bottom face 14 being perpendicular to the bottom face 14. The front face ha is a portion of the peripheral face of the cone. Furthermore, the nasal section 12 and the side sections 13 are also a portion of the peripheral face. Each viewing section 11 has top and bottom faces 11*c* and 11*d* spaced in a vertical direction perpendicular to the width direction and the thickness direction. The top face 11*c* of each viewing section 11 has a spacing la to the vertical axis 16 in the thickness direction smaller than a spacing 1*b* between the bottom face 11*d* of the viewing section 11 and the vertical axis 16. Furthermore, a normal plane perpendicular to each viewing section 11 is at an acute angle θ with the vertical axis 16 (FIG. 2). The viewing sections 11, the nasal section 12, and the side sections 13 together form a curved face in a circumferential direction about the vertical axis 16. The nasal section 12 and the viewing sections 11 are at an end portion of a shorter axis 141 of an ellipse. The side sections 13 are at two ends of a longer axis 142 of the ellipse. Thus, each side section 13 has a curvature larger than those of the viewing sections 11 and the nasal section 12. The side sections 13 bend toward two sides of a head of the wearer, providing an ergonomic design.

Figure 5:
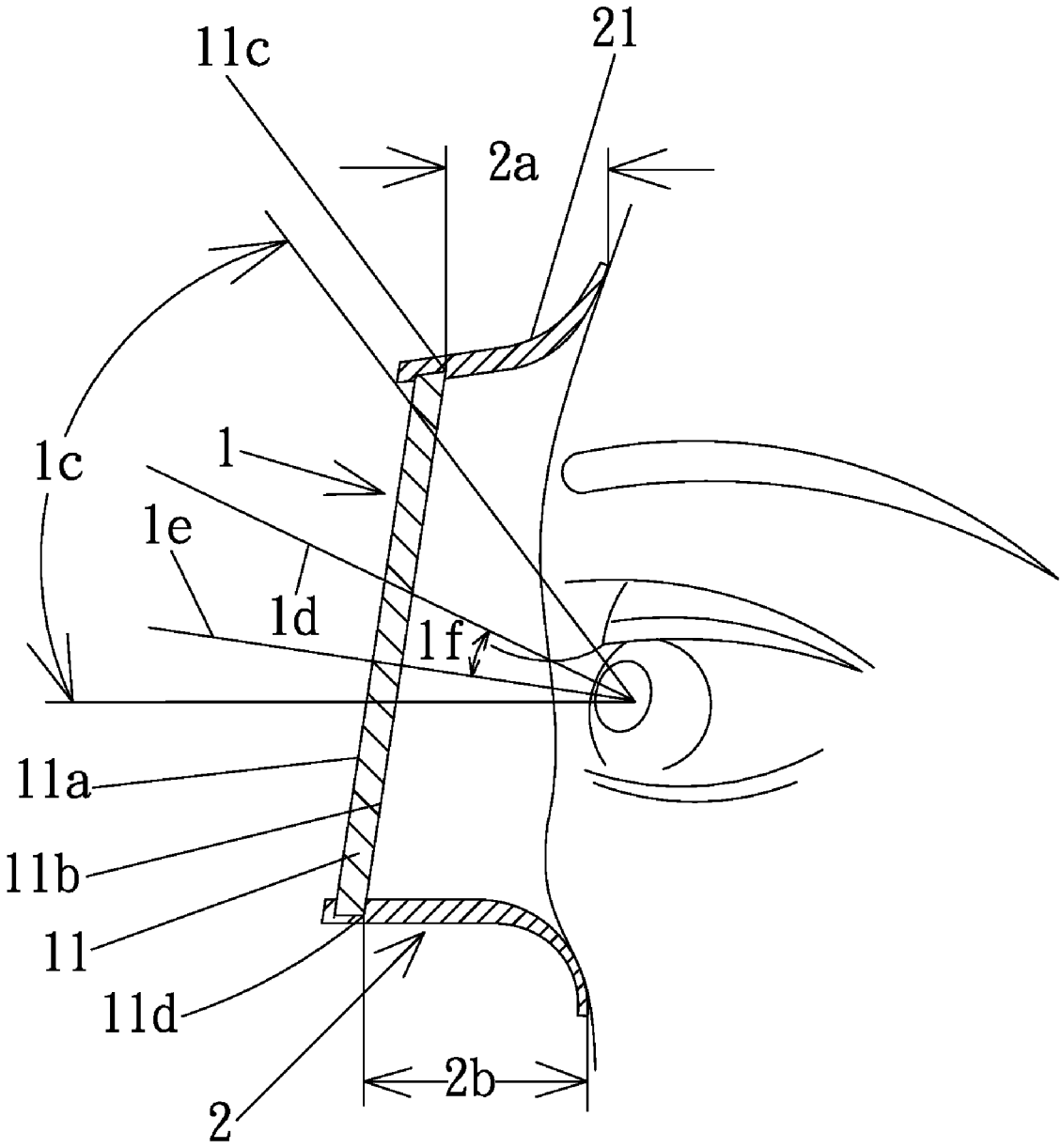
FIG. 5 shows a cross sectional view of the goggles of FIG. 4 worn on the wearer.
Figure 6:
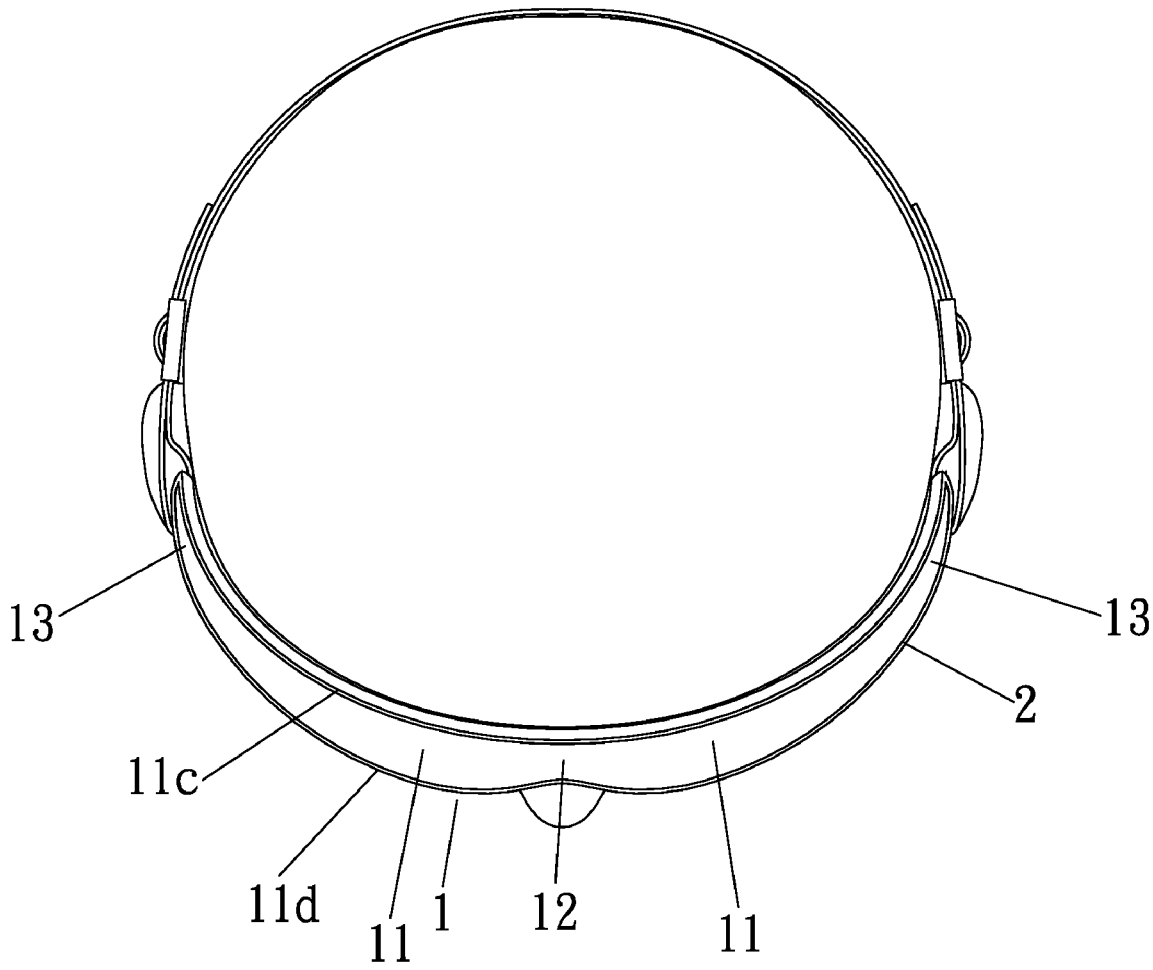
FIG. 6 shows a top view of the goggles of FIG. 4 worn on the wearer.
Figure 7:
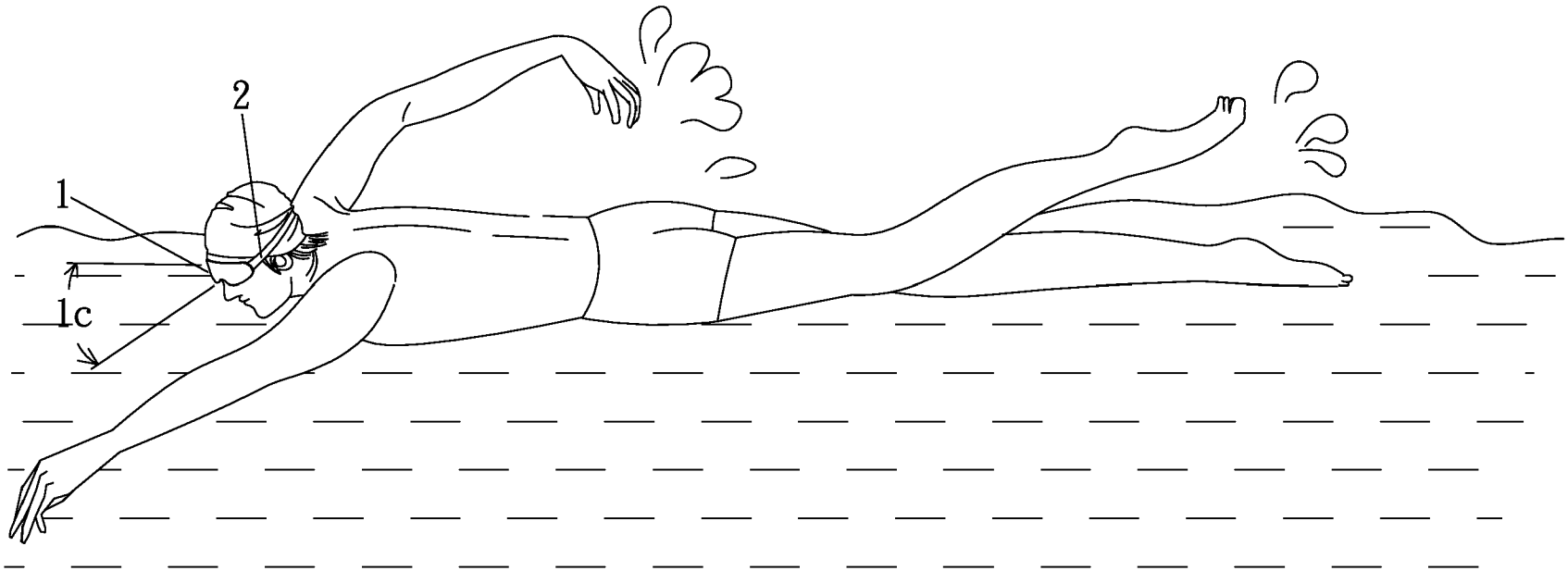
FIG. 7 is a schematic view illustrating the visual field of the goggles of FIG. 1 during swimming.
Figure 8:
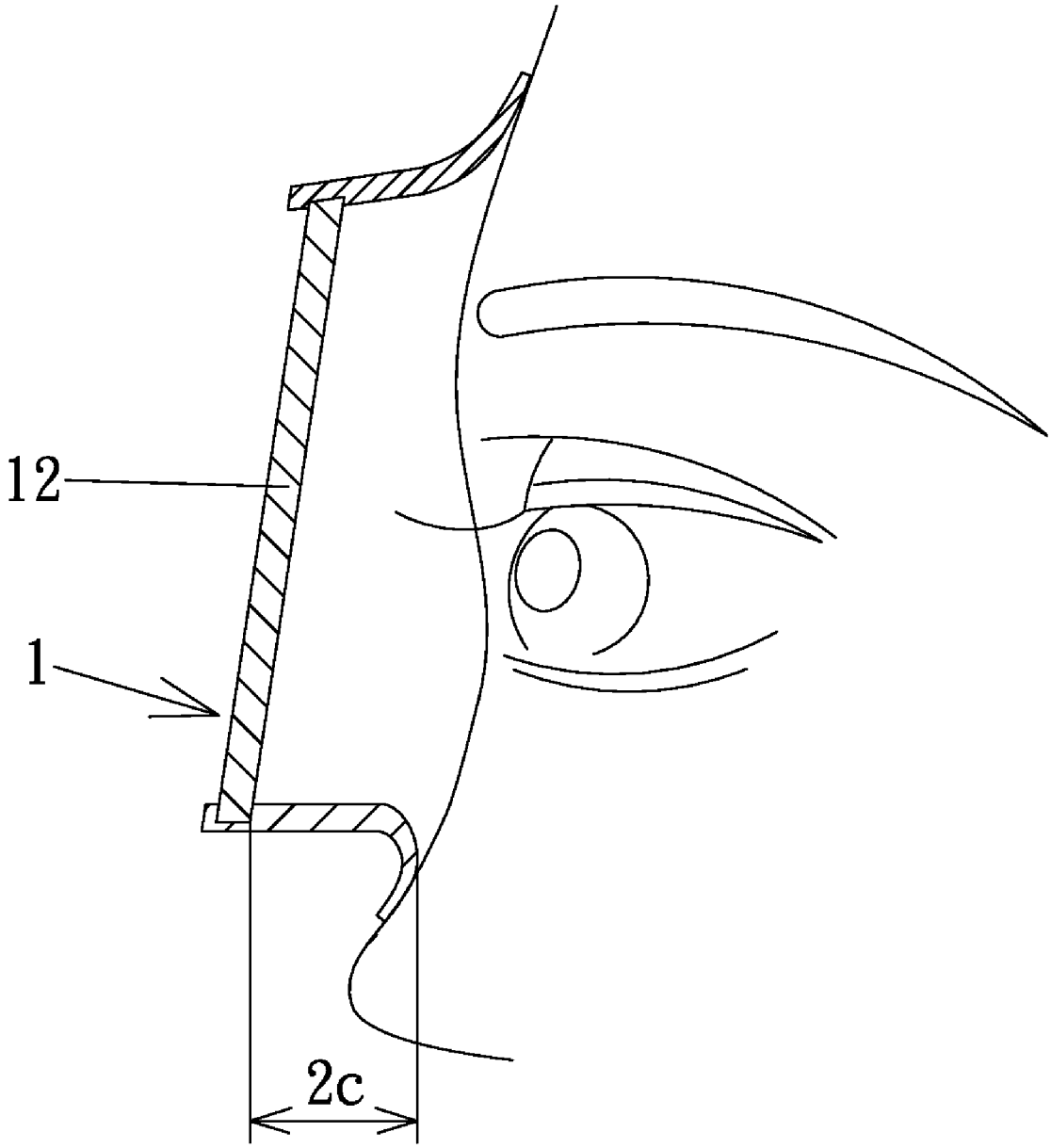
FIG. 8 shows a cross sectional view of the goggles of FIG. 4 illustrating relative position to a nose of the wearer.

The frame mechanism 2 includes an annular frame 21 mounted around and receiving the lens unit 1. The frame mechanism 2 further includes a head strap 22 coupled to the annular frame 21 and allows the goggles to be worn on the head of the wearer. The frame 21 has a soft rear end so as to be in intimate contact with the face of the wearer. A spacing 2*a* between the top face 11*c* of each viewing section 11 and the rear end of the frame 21 is smaller than a spacing 2*b* between the bottom face 11*d* of the viewing section 11 and the rear end of the frame 21. Thus, the spacing between the top face 11*c* of each viewing section 11 and the face of the wearer is smaller than that between the bottom face 11*d* of the viewing section 11 and the face of the wearer (FIG. 5).

During swimming, the eyes of the wearer look through the lens unit 1 along an axis 1*d* above and at an acute angle 1*f* with a normal axis 1*e* perpendicular to the lens unit 1. The angle 1*f* is much smaller than that in conventional goggles, providing better visibility and a larger visual field 1*c* while reducing resistance in water by the curved face of the lens unit 1.

The lens unit 1 according to the teachings of the present invention increases a spacing 2*c* between a lower end of the nasal section 12 and the nose of the wearer, reducing pressing force imparted from the rigid lens unit 1 to the nose of the wearer. The soft rear end of the frame 21 allows intimate contact with the nose of the wearer, providing improved wearing comfort.

The smaller the distance between the apex 15 and the bottom face 14 of the cone is, the larger the acute angle θ is. The design allows easy mass production. Since the curved face of the lens unit 1 is a portion of a peripheral face of a cone, an ergonomic design suitable for differing wearers can be easily obtained. Note that the lens unit 1 is suitable for Asians.

Figure 9:
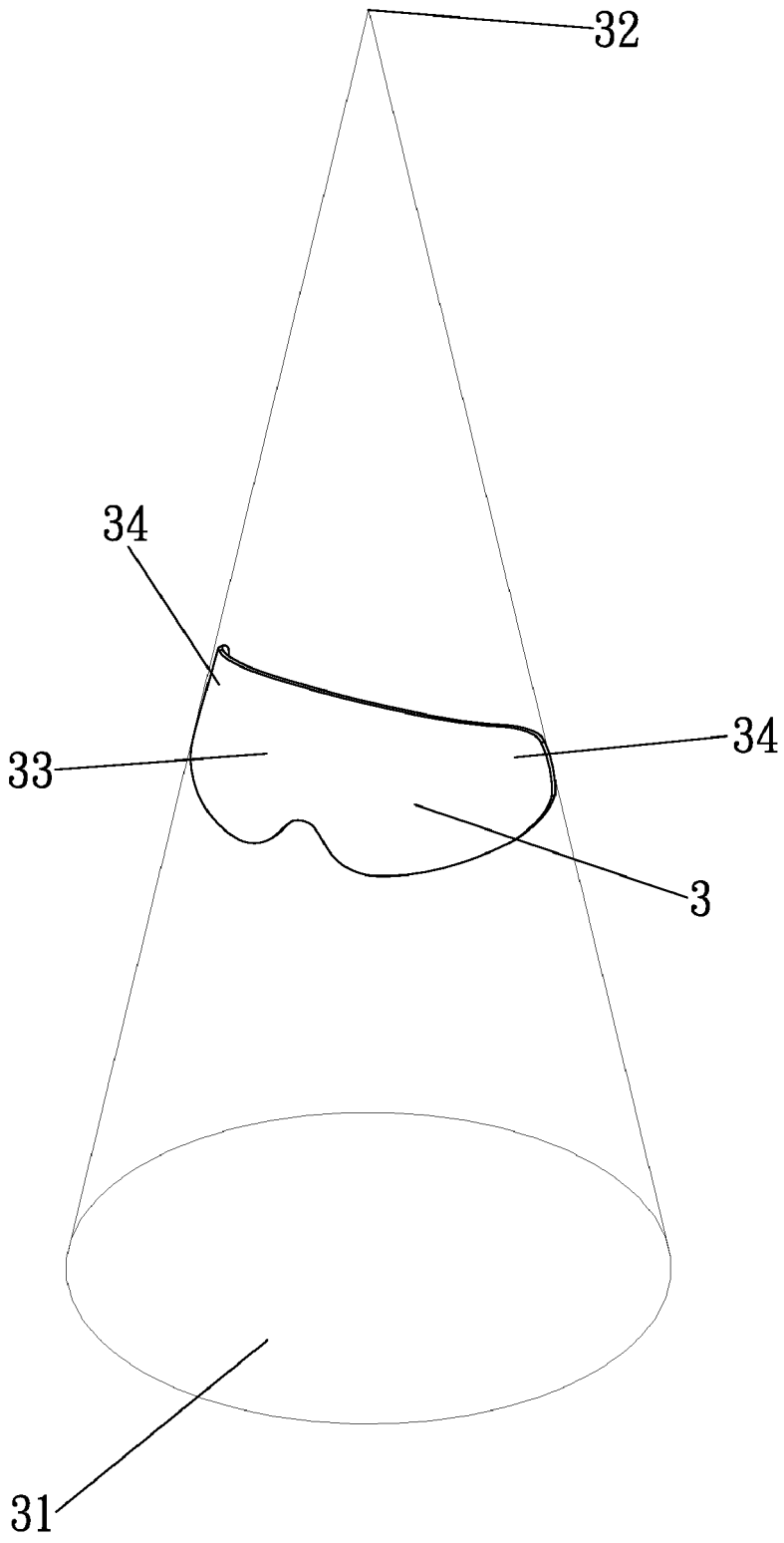
FIG. 9 shows a perspective view of a lens unit of swimming or diving goggles of a second embodiment according to the preferred teachings of the present invention.

FIG. 9 shows a second embodiment of the present invention, wherein the cone includes an apex 32 and a bottom face 31 and includes circular cross sections such that the side sections 34 and the viewing sections 33 have the same curvature. Note that the lens unit 1 of this embodiment is suitable for westerns.

Figure 10:
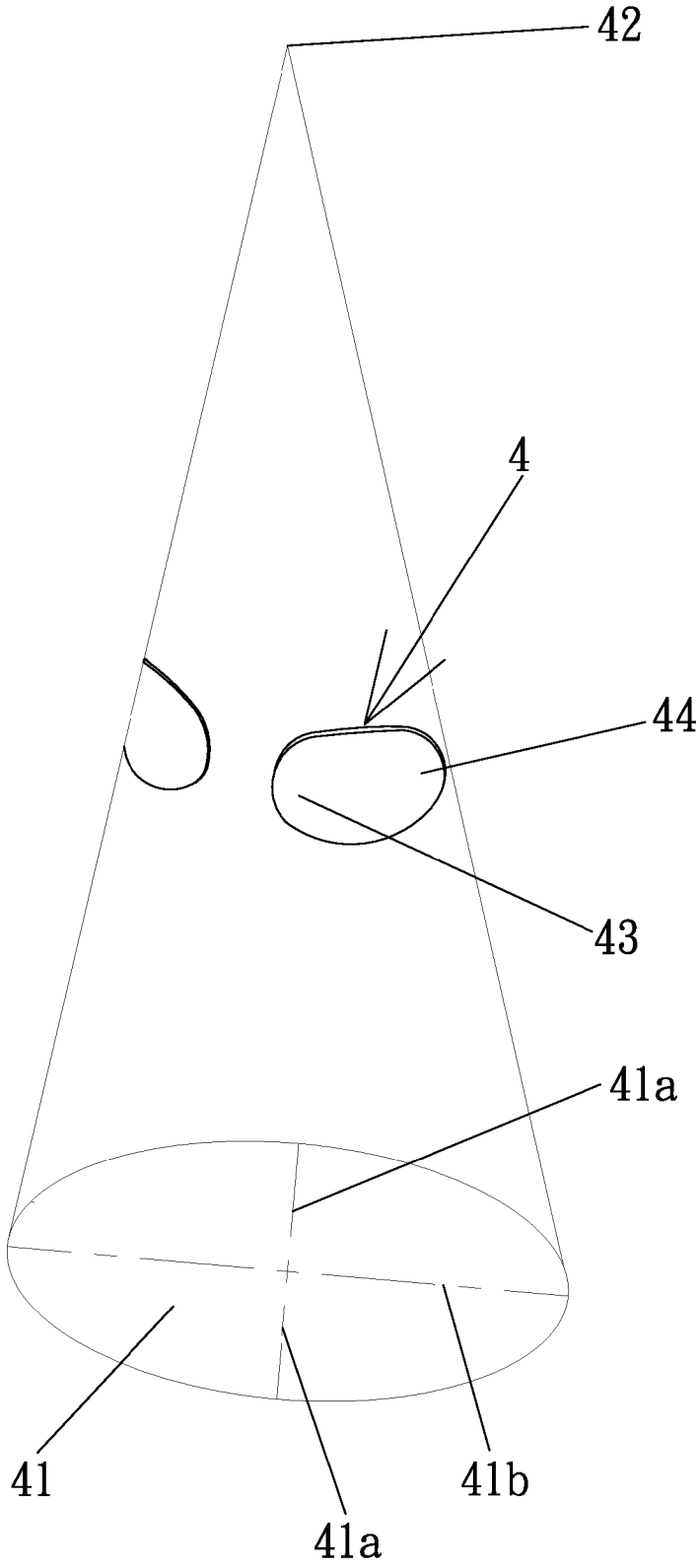
FIG. 10 shows a perspective view of a lens unit of swimming or diving goggles of a third embodiment according to the preferred teachings of the present invention.
Figure 11:
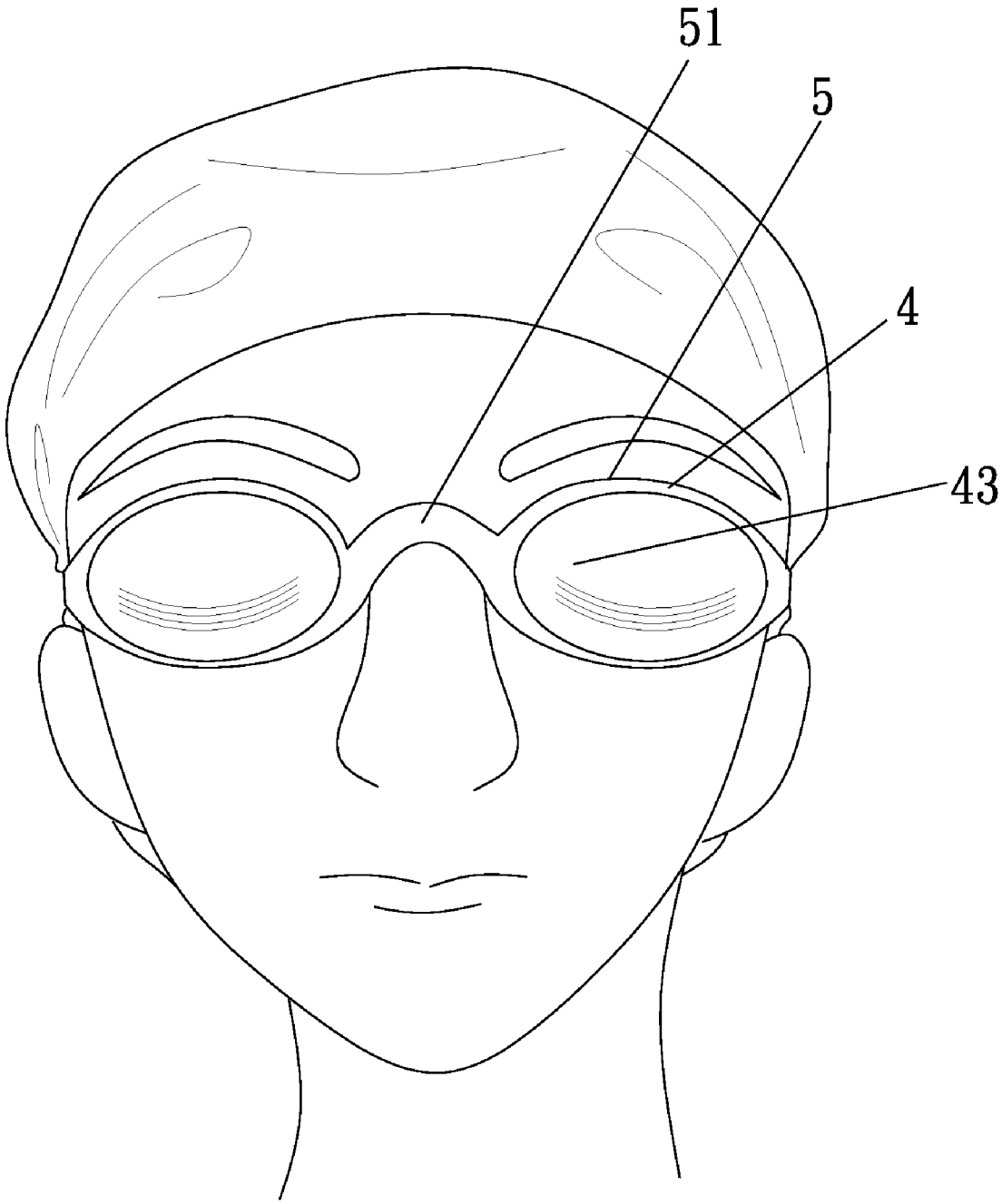
FIG. 11 shows a front view of the goggles of FIG. 10 with the lens unit coupled with a frame mechanism and with the goggles worn on a wearer.
Figure 12:
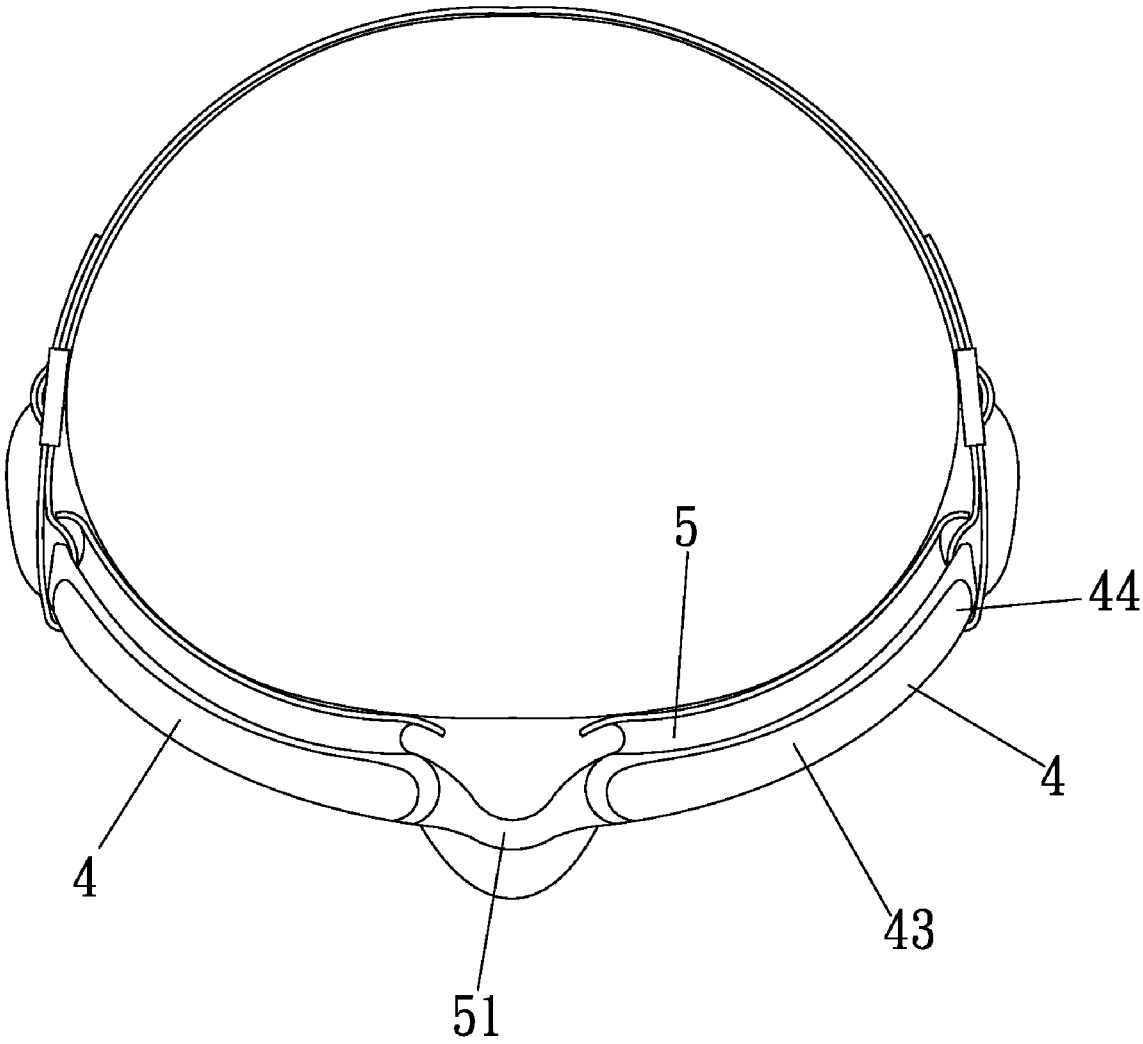
FIG. 12 shows a top view of the goggles of FIG. 11 worn on the wearer.

FIGS. 10-12 show a third embodiment of the present invention, wherein the lens unit includes two separate lenses 4. The cone includes an apex 42 and a bottom face 41 in the form of an ellipse having a shorter axis 41*a* and a longer axis 41*b*. The lenses 4 are a portion of the peripheral face of the cone. The viewing section 43 of each lens 4 corresponds to the area between the nose and one of the temples of the wearer and is located at an end portion of the shorter axis 41*a*. Each side section 44 corresponds to a location of one of the temples of the wearer and is located at one of two ends of the longer axis 41*b*.

Figure 13:
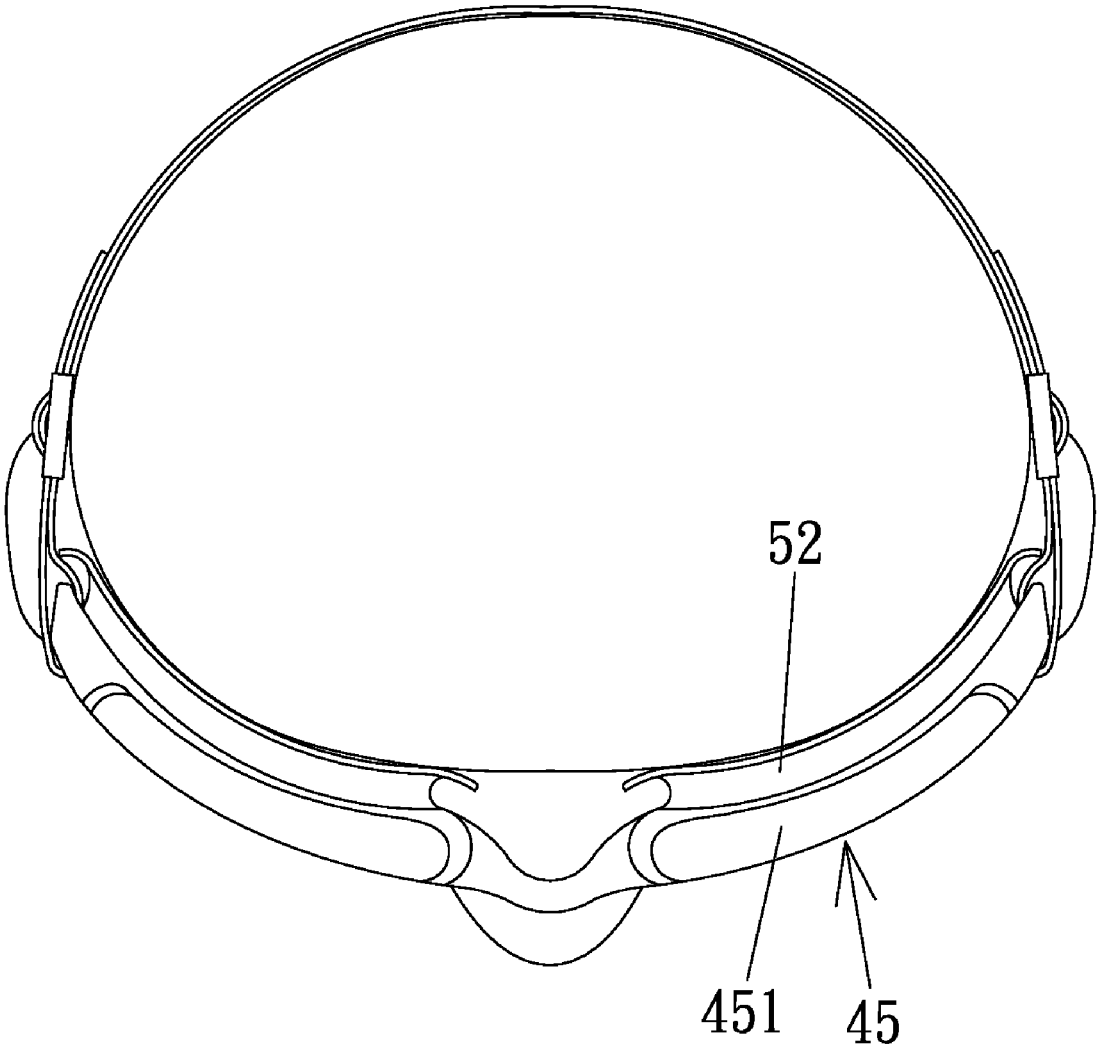
FIG. 13 shows a top view of swimming or diving goggles of a fourth embodiment according to the preferred teachings of the present invention.

FIG. 13 shows a fourth embodiment of the present invention, wherein each lens 45 in this embodiment includes a viewing section 451 and has a width in the width direction smaller that that of the lens 4 in the third embodiment. A frame mechanism 52 is coupled to the lenses 45 allowing the goggles to be worn on the head of the wearer. Specifically, each lens 45 does not have to include the side section.

Figure 14:
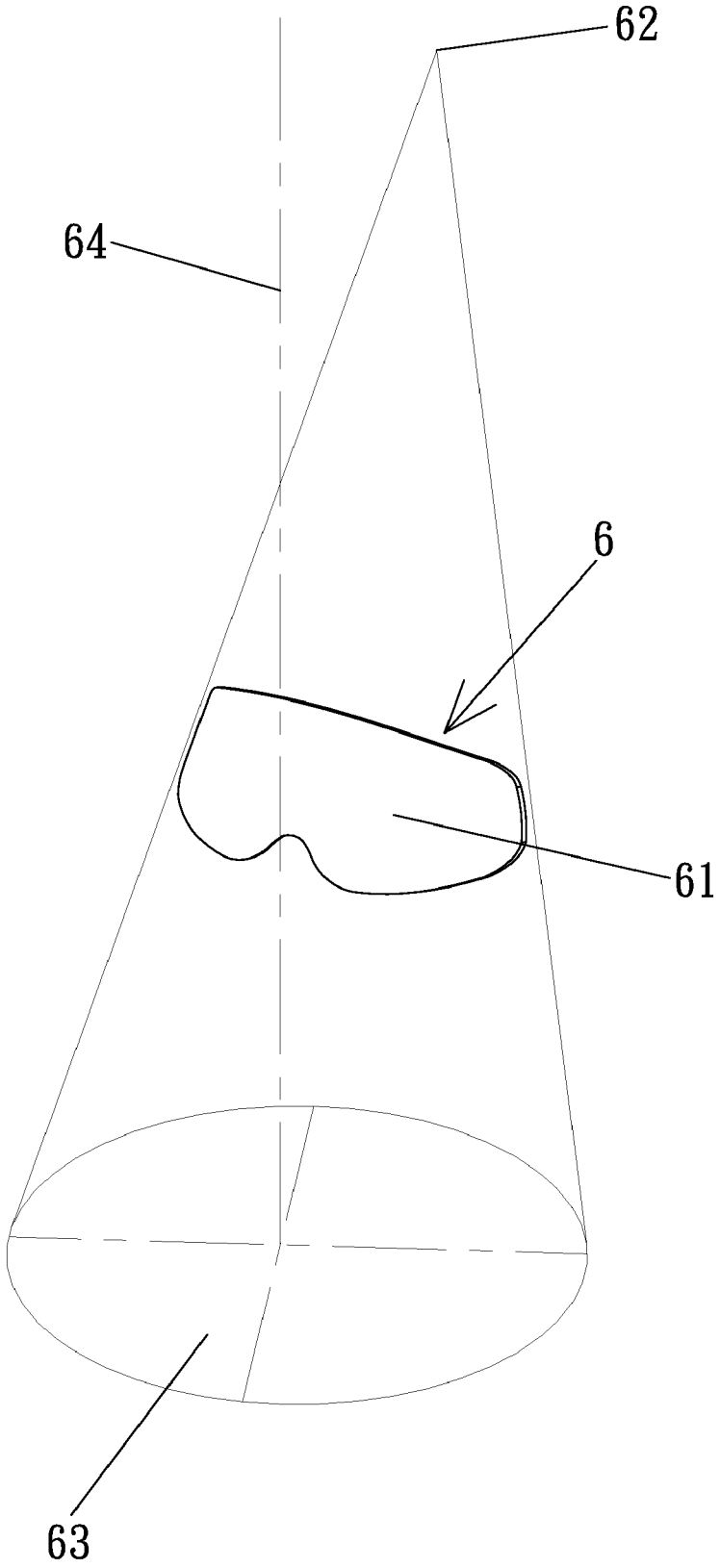
FIG. 14 shows a perspective view of a lens unit of swimming or diving goggles of a fifth embodiment according to the preferred teachings of the present invention.

The cone can be varied to include differing curvatures and differing slopes according to design needs. FIG. 14 shows a fifth embodiment of the present invention. In this embodiment, each viewing section 61 of the lens unit 6 is a portion of a peripheral face of a cone having an apex 62 and a bottom face 63. However, the apex 62 is not located in the vertical axis 64 passing through the center of the bottom face 63.

Figure 15:
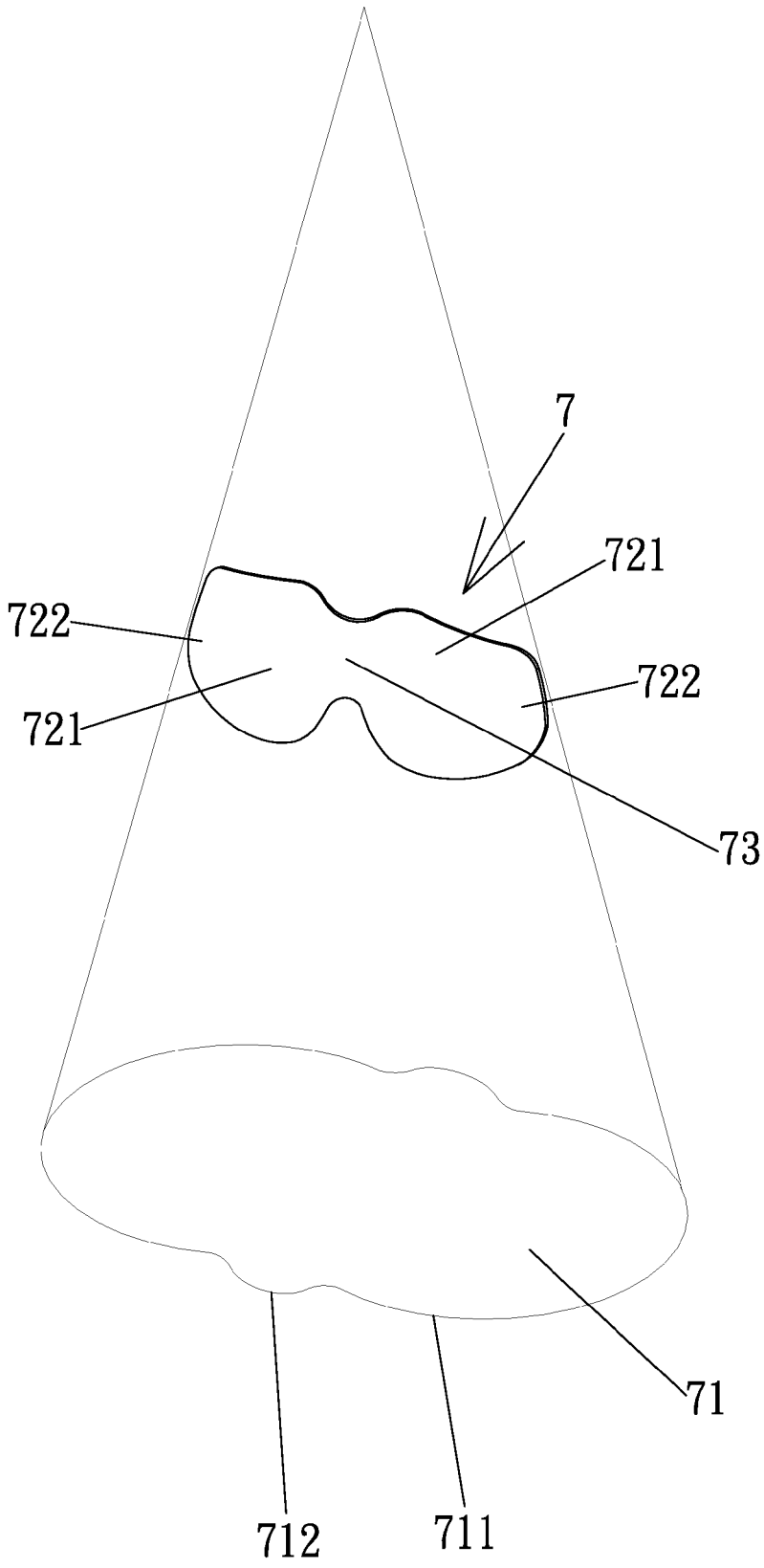
FIG. 15 shows a perspective view of a lens unit of swimming or diving goggles of a sixth embodiment according to the preferred teachings of the present invention.

FIG. 15 shows a sixth embodiment of the present invention. In this embodiment, the cone includes a bottom face 71 having two arcuate portions 711 and two bulge portions 712. The lens 7 includes a nasal section 73, two viewing sections 721 and two side sections 722. The arcuate portions 711 correspond to the viewing sections 721 and the side sections 722.

One of the bulge portions 712 corresponds to the nasal section 73 to further reduce pressing force imparted to the nose of the wearer.

Figure 16:
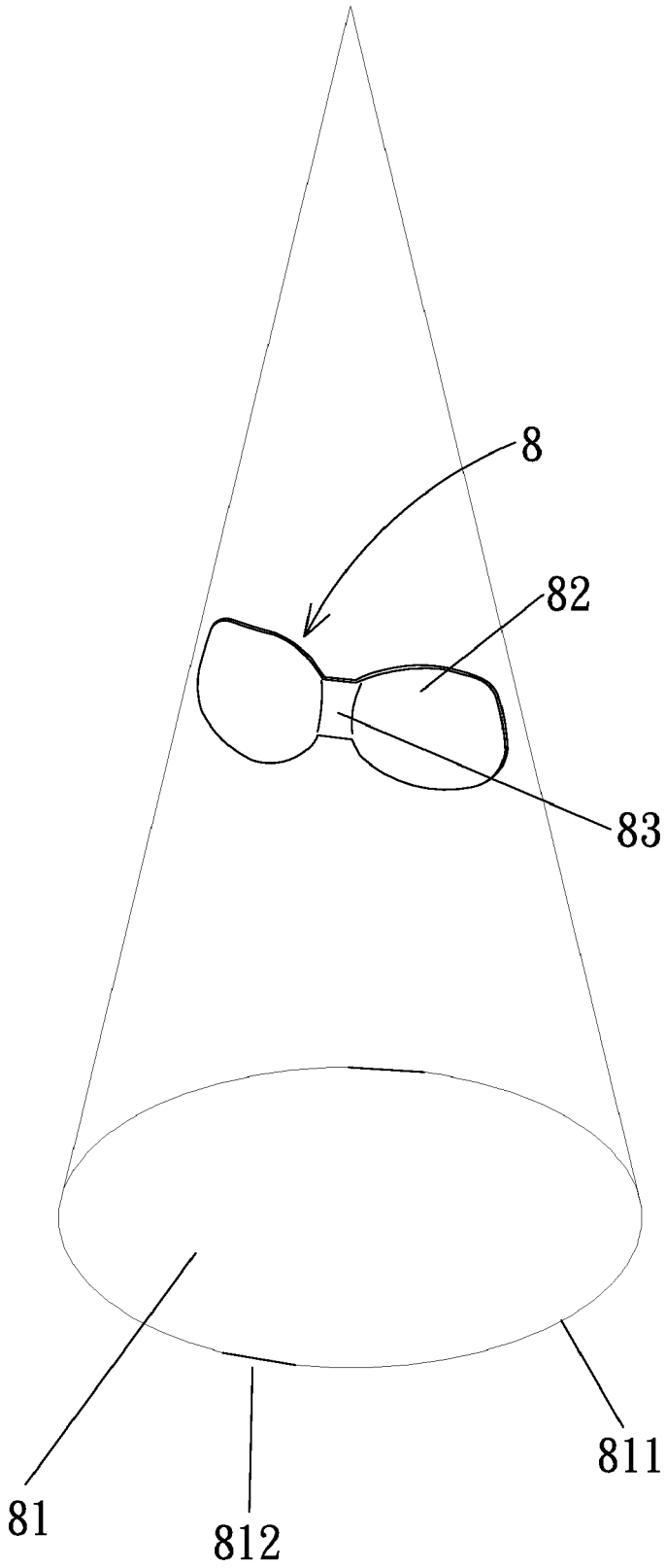
FIG. 16 shows a perspective view of a lens unit of swimming or diving goggles of a seventh embodiment according to the preferred teachings of the present invention.

FIG. 16 shows a seventh embodiment of the present invention, wherein the cone includes a bottom face 81 having two arcuate portions 811 and two rectilinear portions 812. The arcuate portions 811 correspond to the viewing sections 82 of the lens 8. One of the rectilinear portions 812 corresponds to the nasal section 83 of the lens 8. The nasal section 83 will not interfere with the visual angle during use.

Figure 17:
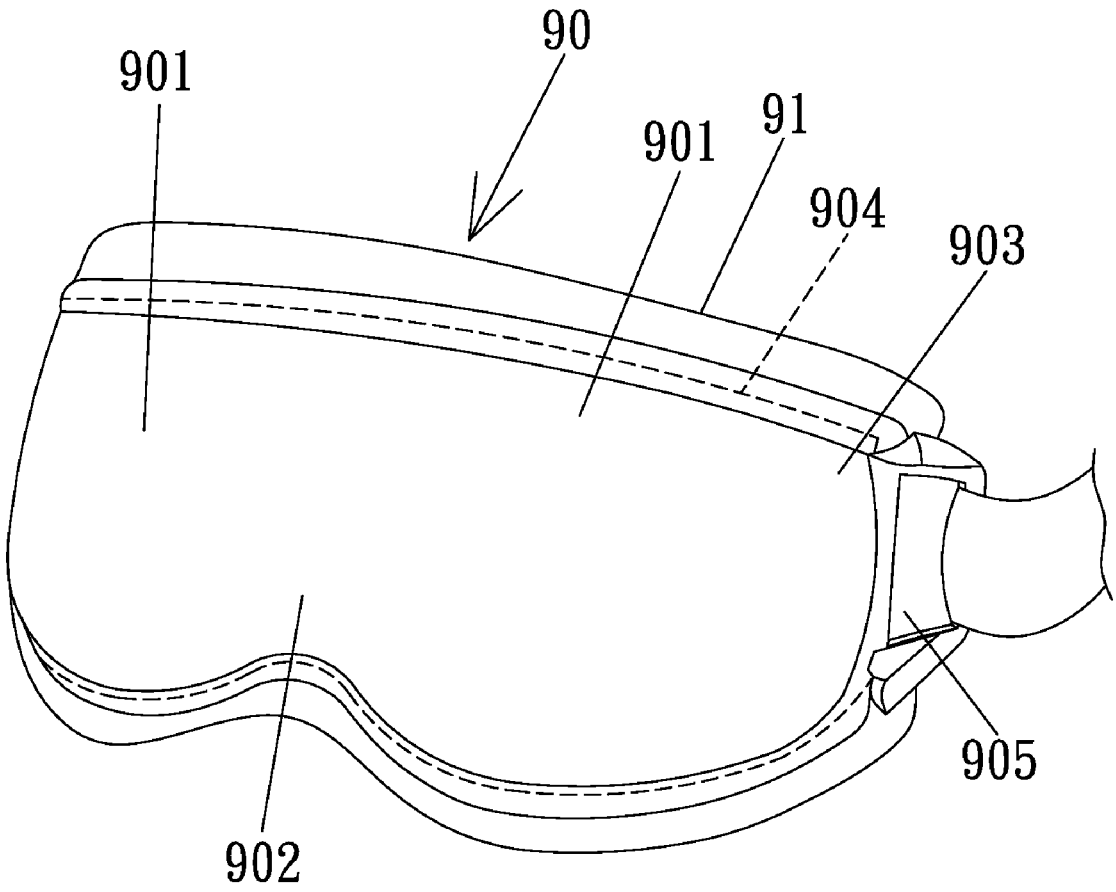
FIG. 17 shows a perspective view of a lens unit of swimming or diving goggles of an eighth embodiment according to the preferred teachings of the present invention.
Figure 18:
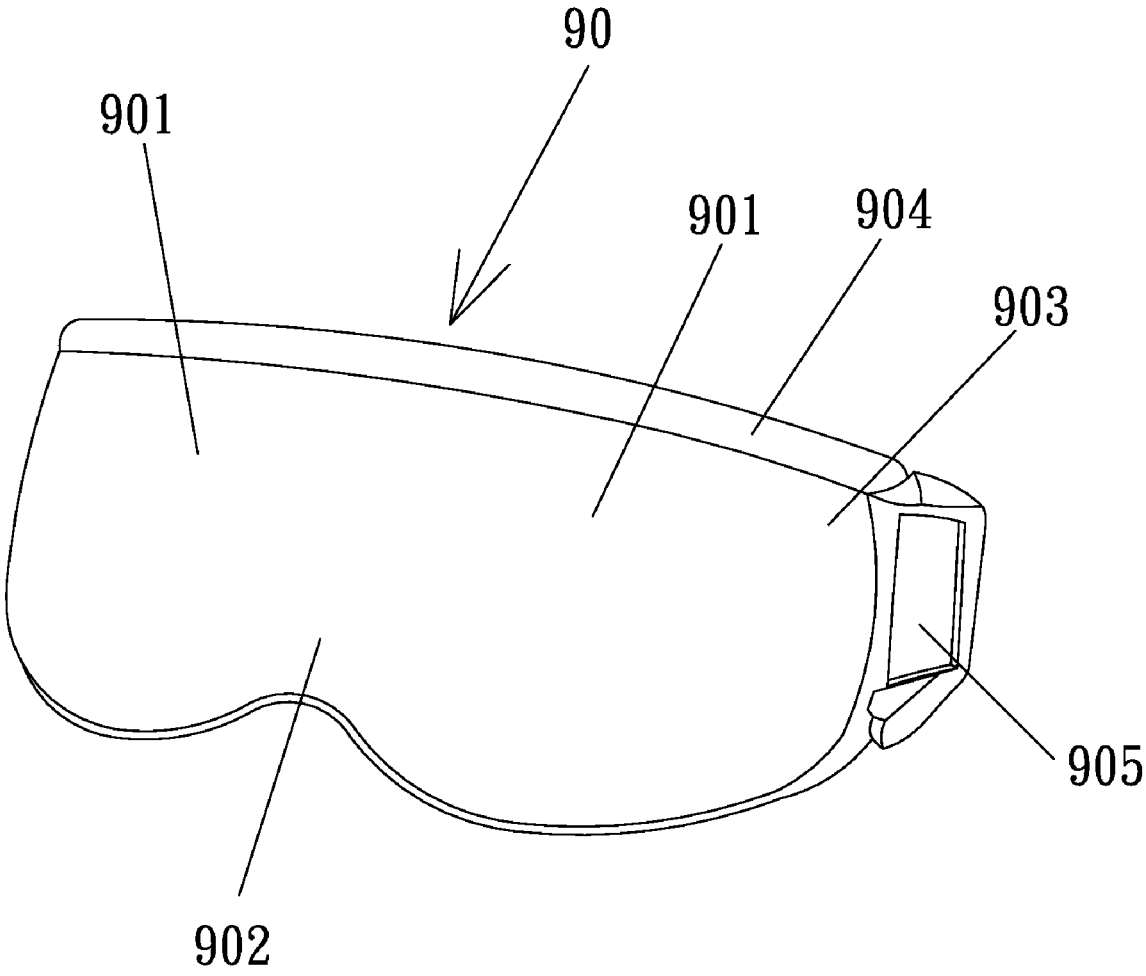
FIG. 18 shows a perspective view of the lens unit of FIG. 17 coupled with a frame mechanism.

The lens unit according to the teachings of the present invention can include an extension extending from the viewing sections, the nasal section, or the side sections without adversely affecting the visual field. Such an extension does not have to be a part of the periphery face of the cone. As an example shown in FIGS. 17 and 18 showing an eighth embodiment of the present invention, the lens unit 90 includes two viewing sections 901, a nasal section 902, and two side sections 903. Each viewing section 901 is a portion of a peripheral face of a cone. Extensions 904 extend from the viewing sections 901, the nasal section 902, and the side sections 903. The lens unit 90 further includes flanges and openings 905 for coupling with a frame mechanism 91.

Figure 19:
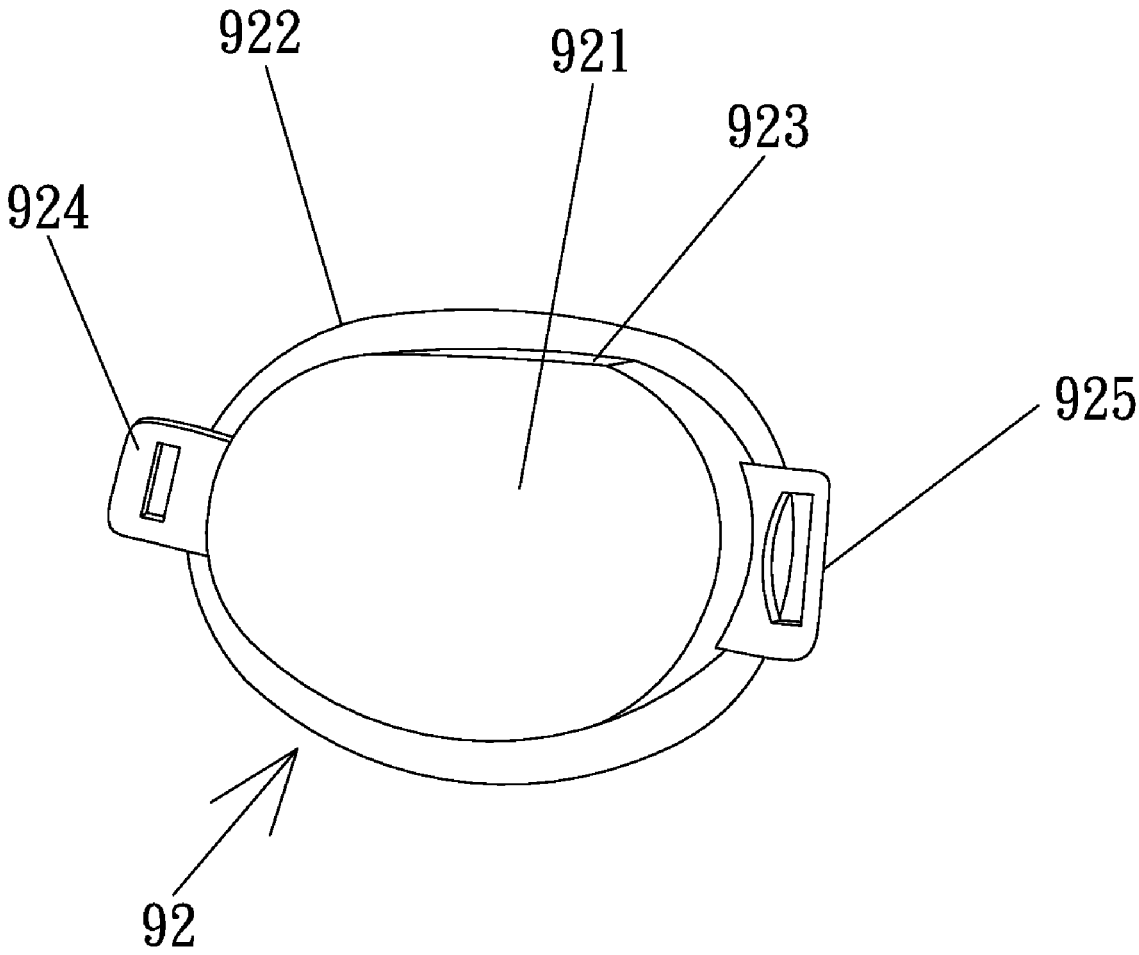
FIG. 19 shows a perspective view of a lens unit of swimming or diving goggles of a ninth embodiment according to the preferred teachings of the present invention.
Figure 20:
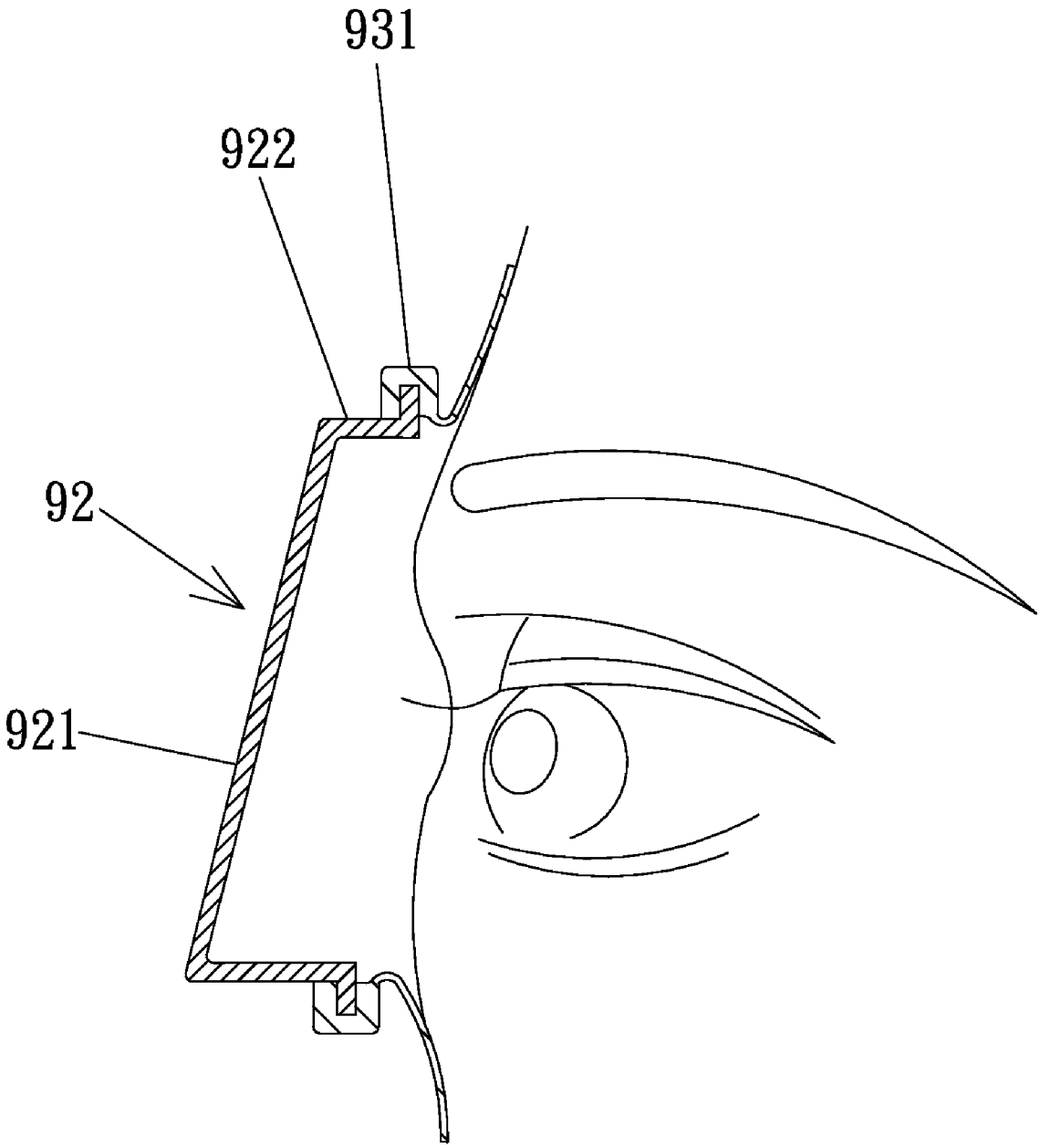
FIG. 20 shows a cross sectional view of the goggles of FIG. 19 with the lens unit coupled with a frame mechanism and with the goggles worn on a wearer.
Figure 21:
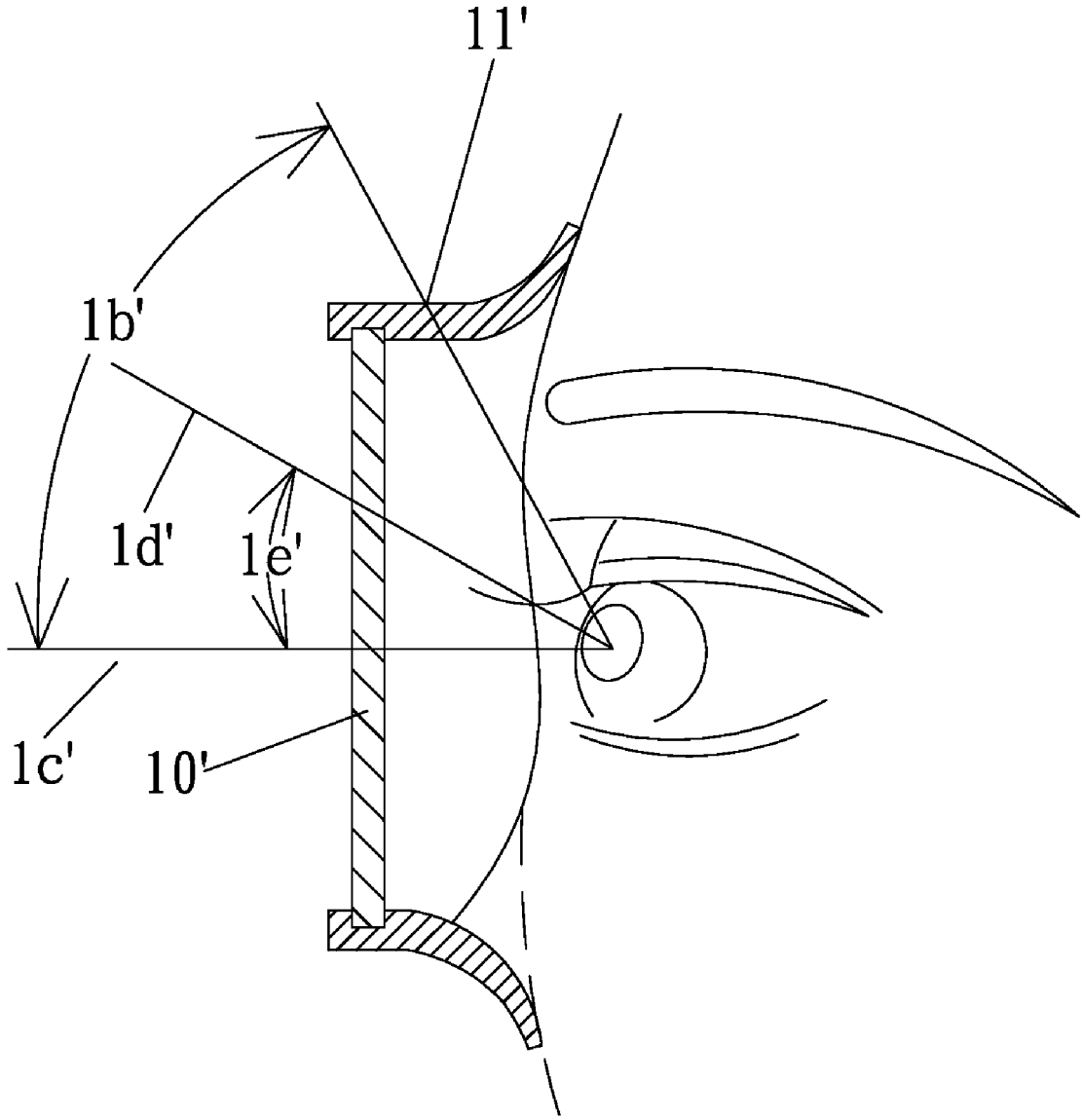
F I G .21 Prior Art
FIG. 21 shows a cross sectional view of conventional swimming or diving goggles worn on a wearer.
Figure 22:
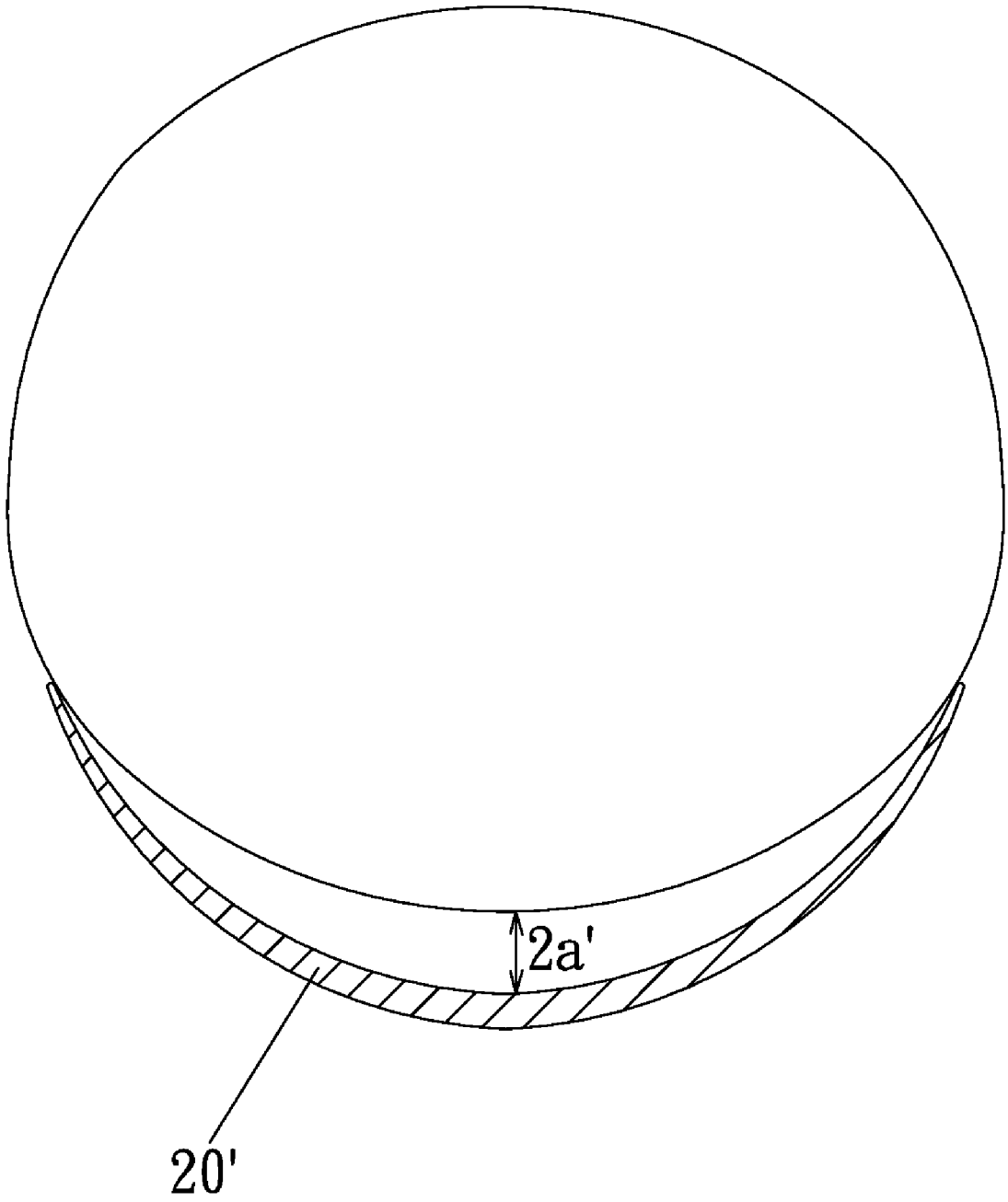
F I G . 22 Prior Art
FIG. 22 shows a cross sectional view of another conventional swimming or diving goggles.
Figure 23:
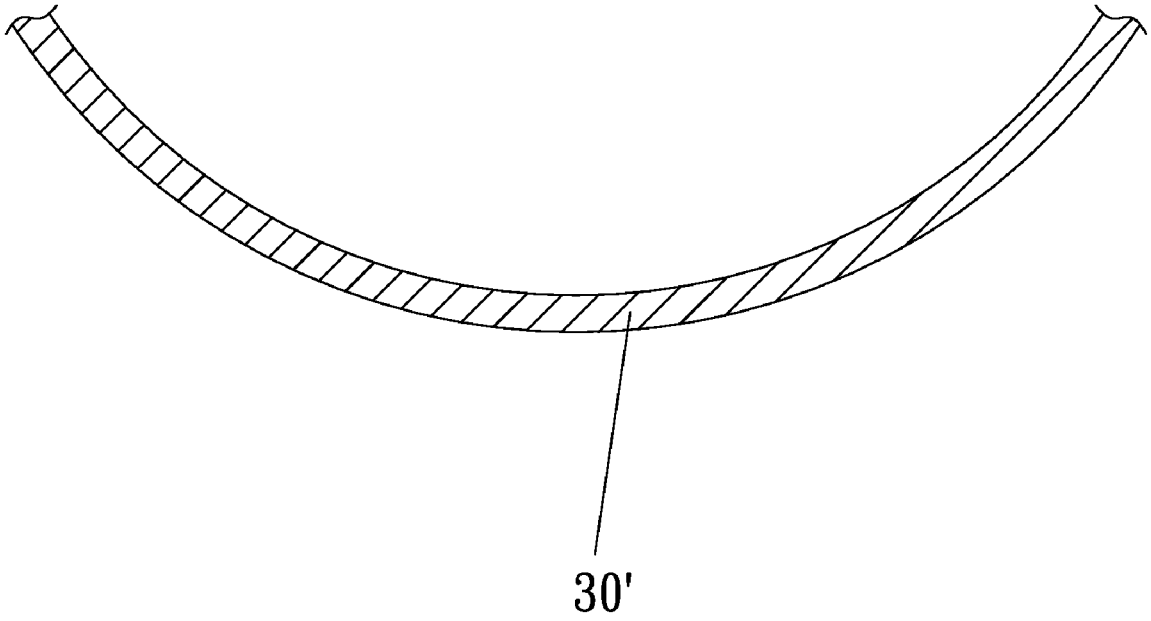
F I G . 23 Prior Art
FIG. 23 shows a cross sectional view of another conventional swimming or diving goggles.
Figure 24:
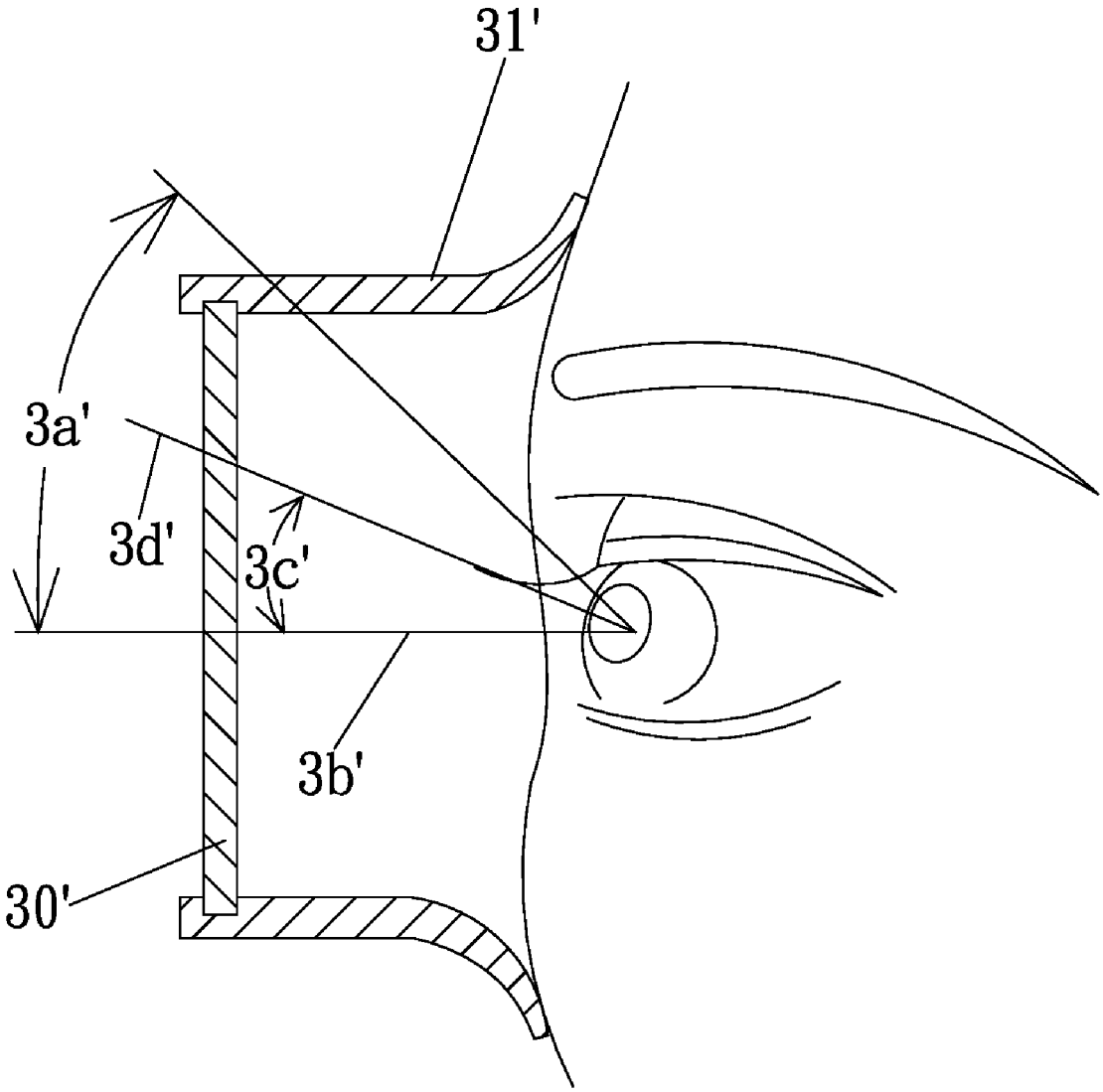
F I G .24 Prior Art
FIG. 24 shows a cross sectional view of another conventional swimming or diving goggles.

FIGS. 19 and 20 show a ninth embodiment of the present invention, wherein the lens unit includes two lenses 92 each having a viewing section 921 that is a portion of a peripheral face of a cone. Each lens 92 includes an extension 922 not a portion of the peripheral face of the cone. The extension portion 922 extends rearward from the viewing section 921. Each lens 92 includes a flange 923, a bridge coupling portion 924, and a head coupling portion 925 for coupling with a padding member 931, a bridge, and an end of a head strap of a frame mechanism. By providing the extension 922, differing frame mechanisms can be coupled to the lenses 92. Furthermore, the extension portion 922 can have differing shapes according to design needs.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. Swimming or diving goggles comprising:

a lens unit of rigid material, including two separate lenses or a single monolithic lens with a thickness, with the lens unit including two viewing sections: each having a front and a rear face spaced from along the direction of thickness, with the front face being a portion of a peripheral face of a cone, with the cone having an apex and a bottom face, with the peripheral face extending between the apex and the bottom face, with each of the two viewing sections having a top face and a bottom face spaced in a vertical direction perpendicular to the thickness direction, with a spacing 1*a* less than a spacing 1*b*, wherein the spacing 1*a* is defined as the distance along the direction of thickness from the top face of each of the two viewing sections to a vertical axis passing through a center of the bottom face of the cone, and the spacing 1*b* is defined as the distance along the direction of thickness from the bottom face of each of the viewing sections to the vertical axis passing through the center of the bottom face of the cone, with a normal plane perpendicular to each of the two viewing sections being at an acute angle with the vertical axis, with each of the two viewing sections being a curved face in a circumferential direction, axially around the vertical axis; and a frame mechanism coupled to the lens unit and in intimate contact with eye sockets of a wearer wearing the swimming or diving goggles.

2. The swimming or diving goggles as claimed in claim 1, with each of the two viewing sections corresponding to an area between a nose and one of two temples of the wearer.

3. The swimming or diving goggles as claimed in claim 2, with the lens unit further including two side sections on opposite sides of the two viewing sections, with each of the side sections corresponding to a location of one of the temples of the wearer.

4. The swimming or diving goggles as claimed in claim 2, with the lens unit being a single monolithic lens including the two viewing sections, with the single monolithic lens further including a nasal section intermediate the two receiving sections, and with the nasal section corresponding to a location of the nose of the wearer.

5. The swimming or diving goggles as claimed in claim 3, with the bottom face being an ellipse having a shorter axis and a longer axis, with the two viewing sections being on an end portion of the shorter axis, with the side sections being on two ends of the longer axis, and with each of the two side sections having a longer radius of curvature than that of the two viewing sections.

6. The swimming or diving goggles as claimed in claim 1, with the frame mechanism including an annular frame receiving the lens unit, and with the annular frame including a soft rear end in intimate contact with a face of the wearer.

7. The swimming or diving goggles as claimed in claim 4, with the bottom face including two arcuate portions and two bulge portions, and with the two arcuate portions corresponding to the two viewing sections, with one of the two bulge portions corresponding to the nasal section.

8. The swimming or diving goggles as claimed in claim 1, with the lens unit further including an extension, with the extension being not a portion of the peripheral face of the cone.

9. The swimming or diving goggles as claimed in claim 8, with the extension coupled to the frame mechanism.

10. The swimming or diving goggles as claimed in claim 1, with the lens unit further including an extension, with the extension being a portion of the peripheral face of the cone.

11. The swimming or diving goggles as claimed in claim 10, with the extension coupled to the frame mechanism.

* * * * *